US008447216B2

(12) United States Patent
Oba et al.

(10) Patent No.: US 8,447,216 B2
(45) Date of Patent: May 21, 2013

(54) DEVELOPMENT UNIT, IMAGE FORMING APPARATUS, AND GAP ADJUSTING METHOD

(75) Inventors: Shota Oba, Kanagawa (JP); Shigeru Inaba, Kanagawa (JP); Takashi Ochi, Kanagawa (JP); Yoshitaka Nakajima, Kanagawa (JP); Shinichi Kuramoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 165 days.

(21) Appl. No.: 13/032,160

(22) Filed: Feb. 22, 2011

(65) Prior Publication Data

US 2012/0051796 A1 Mar. 1, 2012

(30) Foreign Application Priority Data

Aug. 31, 2010 (JP) ..... 2010-194265

(51) Int. Cl.
*G03G 15/08* (2006.01)

(52) U.S. Cl.
USPC ..... 399/272; 399/274

(58) Field of Classification Search
USPC ..... 399/272, 274, 281, 282, 284, 269
See application file for complete search history.

(56) References Cited

U.S. PATENT DOCUMENTS

| | | | | |
|---|---|---|---|---|
| 5,995,790 | A * | 11/1999 | Takeda | 399/274 |
| 7,283,761 | B2 * | 10/2007 | Matsuda et al. | 399/53 |
| 7,949,267 | B2 * | 5/2011 | Nakasha | 399/44 |
| 8,180,263 | B2 * | 5/2012 | Kukuchi | 399/281 |
| 2008/0226354 | A1 | 9/2008 | Ramesh et al. | |
| 2010/0124428 | A1 * | 5/2010 | Tabata et al. | 399/57 |

FOREIGN PATENT DOCUMENTS

| | | | |
|---|---|---|---|
| JP | 05158338 | A * | 6/1993 |
| JP | 09114253 | A * | 5/1997 |
| JP | 11133729 | A * | 5/1999 |
| JP | 2001175066 | A * | 6/2001 |
| JP | A-2006-146286 | | 6/2006 |
| JP | A-2008-225478 | | 9/2008 |

* cited by examiner

*Primary Examiner* — Robert Beatty
(74) *Attorney, Agent, or Firm* — Oliff & Berridge, PLC

(57) ABSTRACT

A development unit includes: a developing vessel in which a developing agent is received; a developing member as defined herein; a supply member which is supported in the developing vessel and disposed to be opposed to the developing member, the supply member rotating the developing agent in the developing vessel while holding the developing agent on a surface of the supply member to thereby supply the developing agent held on the surface to the developing member; and a thickness limiting member as defined herein, and the supply member is supported movably in a direction to expand or reduce a gap between the thickness limiting member and the supply member so that the gap between the thickness limiting member and the supply member can be adjusted.

15 Claims, 7 Drawing Sheets

DEVELOPMENT UNIT, IMAGE FORMING APPARATUS, AND GAP ADJUSTING METHOD

CROSS-REFERENCE TO RELATED APPLICATIONS

This application is based on and claims priority under 35 USC 119 from Japanese Patent Application No. 2010-194265 filed on Aug. 31, 2010.

BACKGROUND

Technical Field

The present invention relates to a development unit, an image forming apparatus, and a gap adjusting method.

SUMMARY

According to an aspect of the invention, there is provided a development unit including: a developing vessel in which a developing agent is received; a developing member which is opposed to an image holder on which a latent image is formed, the developing member rotating while holding the developing agent on a surface thereof, to thereby develop the latent image on the surface of the image holder into a visible image; a supply member which is supported in the developing vessel and disposed to be opposed to the developing member, the supply member rotating the developing agent in the developing vessel while holding the developing agent on a surface of the supply member to thereby supply the developing agent held on the surface to the developing member; and a thickness limiting member which is supported in the developing vessel and disposed to be opposed to the supply member on an upstream side of a position where the supply member is opposed to the developing member with respect to a rotational direction of the supply member, the thickness limiting member limiting thickness of the developing agent held on the surface of the supply member; wherein: the supply member is supported movably in a direction to expand or reduce a gap between the thickness limiting member and the supply member so that the gap between the thickness limiting member and the supply member can be adjusted.

BRIEF DESCRIPTION OF THE DRAWINGS

Exemplary embodiments of the present invention will be described in detail based on the following figures, wherein.

DESCRIPTION OF REFERENCE NUMERALS AND SIGNS

Figure 1:
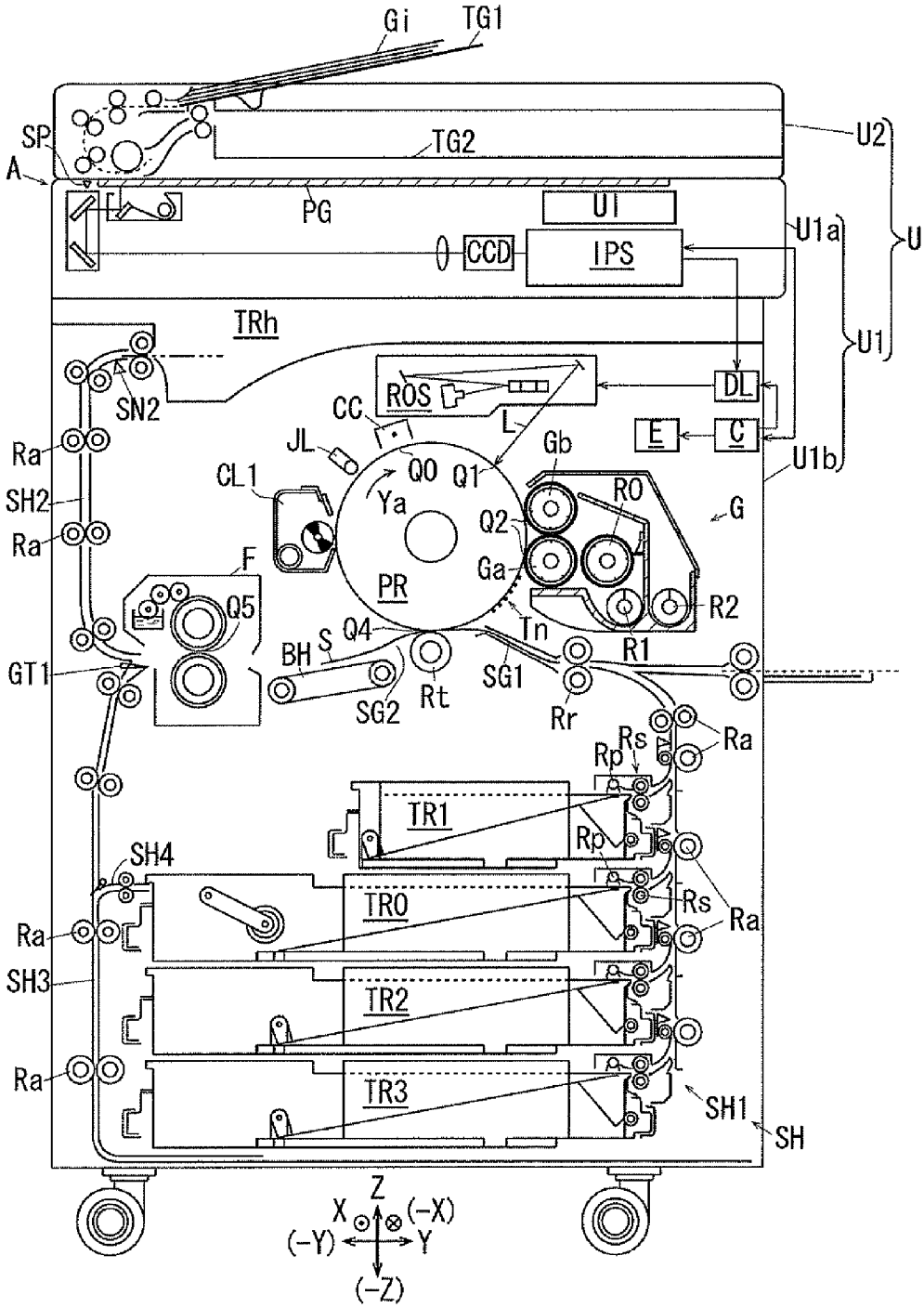
FIG. 1 is an overall view for explaining an image forming apparatus according to Example 1 of the invention.

8 thickness limiting member
23 positioned portion
25,29 positioning member
F fixing unit
G development unit
G3 transmitted member
G7 transmitting member
Ga first developing member
Ga,Gb developing member
Gb second developing member
PR image holder
R0 supply member
ROS latent image forming unit
Rt transfer unit
U image forming apparatus
V developing vessel

DETAILED DESCRIPTION

Although specific examples of an exemplary embodiment of the invention (hereinafter referred to as "Examples") will be described below with reference to the drawings, the invention is not limited to the following Examples.

In order to facilitate understanding of the following description, in the drawings, the front-rear direction is indicated as an X-axis direction, the left-right direction is indicated as a Y-axis direction and the up-down direction is indicated as a Z-axis direction, and directions or sides designated by the arrows X, −X, Y, −Y, Z and −Z are indicated as a front direction, a rear direction, a right direction, a left direction, an upper direction and a lower direction, or a front side, a rear side, a right side, a left side, an upper side and a lower side, respectively.

In the drawings, each arrow with "•" written in "o" means an arrow directed from the back side of the sheet to the front side thereof and each arrow with "x" written in "o" means an arrow directed from the front side of the sheet to the back side thereof.

In the following description using the drawings, any other member than members required for description is omitted from the drawings suitably for the purpose of facilitating understanding.

EXAMPLE 1

FIG. 1 is an overall view for explaining an image forming apparatus according to Example 1 of the invention.

In FIG. 1, a copying machine U as an example of the image forming apparatus has a copying machine body U1 and a document conveyance unit U2. The copying machine body U1 has a platen glass PG as an example of a transparent document table in the top surface of the copying machine body U1. The document conveyance unit U2 is removably attached onto the platen glass PG.

The document conveyance unit U2 has a document tray TG1 as an example of a document receiving portion in which a plurality of documents Gi to be copied are stacked and received. The documents Gi received in the document tray TG1 are sequentially passed through a copying position on the platen glass PG and ejected to a document ejection tray TG2 as an example of a document ejection portion.

The copying machine body U1 has a user interface UI as an example of an operation portion, a scanner portion U1*a* as an example of an image reading portion, a printer portion U1*b* as an example of an image recording portion, and an image processing portion IPS. The scanner portion U1*a* and the printer portion U1*b* are disposed under the platen glass PG.

The scanner portion U1*a* has an exposure-system registration sensor Sp as an example of a reference detection member, and an exposure optical system A. The exposure-system registration sensor Sp is disposed in a reference position for reading.

The exposure optical system A is controlled to move and stop based on a detection signal of the exposure-system registration sensor Sp. The exposure optical system A always stays in the reference position.

When the document conveyance unit U2 is used to make a copy, a document Gi passing through a reading position on the platen glass PG is exposed to light by the exposure optical system A stopped in the reference position.

When a worker manually places a document Gi on the platen glass PG, the document on the platen glass PG is exposed to and scanned with light by the exposure optical system A which is moving.

Reflected light from the document Gi exposed to the light passes through the exposure optical system A and is focused on an imaging device COD. The imaging device CCD converts the document reflected light focused on an imaging surface of the imaging device CCD into an electric signal.

The image processing portion IPS converts a read image signal inputted from the imaging device CCD of the scanner portion U1*a* into an image writing signal, and outputs the image writing signal to a latent image forming circuit DL of the printer portion U1*b*.

The latent image forming circuit DL outputs, to a latent image forming unit ROS, a drive signal corresponding to inputted image information.

A photoconductor PR provided as an example of an image holder and disposed under the latent image forming unit ROS rotates in the direction of an arrow Ya. The surface of the photoconductor PR is charged by a charger CC in a charging area Q0. After that, in a latent image forming position Q1, the surface of the photoconductor PR is exposed to and scanned with a laser beam L as an example of writing light from the latent image forming unit ROS. Thus, an electrostatic latent image is formed on the surface of the photoconductor PR. The surface of the photoconductor PR on which the electrostatic latent image has been formed is rotationally moved to a developing area Q2, where the latent image is developed into a visible image by a development unit G. The surface of the photoconductor PR on which the latent image has been developed in the developing area Q2 is passed through a transfer area Q4 where the photoconductor PR is opposed to a transfer roll Rt as a transfer unit.

Sheet feed trays TR1 to TR3 as examples of media receiving portions are disposed below the photoconductor PR. Sheets S as examples of media received in the sheet feed trays TR1 to TR3 or sheets S temporarily received in an inversion tray TR0, which is used for double-sided printing, are extracted by a pickup roll Rp as an example of a medium extracting member. The sheets S extracted by the pickup roll Rp are separated one by one by a separation roll Rs as an example of a separation member, and each sheet S is conveyed to a downstream side by a plurality of conveyance rolls Ra as examples of medium conveyance members. The sheet S conveyed by the conveyance rolls Ra is conveyed to a registration roll Rr as an example of an adjustment member which adjusts the time when the sheet S will be conveyed to the transfer area Q4.

The sheet S conveyed to the registration roll Rr is guided and conveyed to the transfer area Q4 by a pretransfer sheet guide SG1 in sync with the time when a toner image on the photoconductor PR will move to the transfer area Q4. The pretransfer sheet guide SG1 is provided as an example of a guide member.

A toner image Tn developed on the surface of the photoconductor PR is transferred to the sheet S by the transfer roll Rt in the transfer area Q4. The surface of the photoconductor PR after the transfer is cleaned by a photoconductor cleaner CL1 as an example of a cleaner. Thus, residual toner is removed from the surface of the photoconductor PR. Then, the surface of the photoconductor PR is destaticized by a photoconductor destaticizer JL, and charged again by the charger CC.

The charge voltage of the charger CC, the development voltage of the development unit G and the transfer voltage of the transfer roll Rt are supplied from a power supply circuit E. The power supply circuit E is controlled by a controller C as an example of a control portion.

The sheet S to which the toner image has been transferred by the transfer roll Rt in the transfer area Q4 is conveyed to a fixing area Q5 by a sheet guide SG2 as an example of a guide member and a sheet conveyance belt BH as an example of a medium conveyance member. The sheet S passing through the fixing area Q5 is heated by a fixing unit F so that fixation is carried out on the sheet S.

A changeover gate GT1 provided as an example of a changeover member and disposed on the downstream side of the fixing unit F changes over the conveyance direction of the sheet S, which has passed through the fixing unit F, to either an ejection path SH2 or an inversion path SH3. The sheet S conveyed to the ejection path SH2 is ejected to an ejection tray TRh as an example of a medium ejection portion by the conveyance rolls Ra. In the case of double-sided copying, the sheet S to which a toner image on the first side has been transferred is inverted in the inversion path SH3, then passes through a circulation path SH4 and is once received in the inversion tray TR0. The sheet S is extracted by the pickup roll Rp in a predetermined time and sent again to the transfer area Q4, in which a toner image is transferred on the second side.

A sheet conveyance unit SH is constituted by the constituent members referred to by the symbols SH1 to SH4, Rp, Rs, Rr, Ra, GT1, etc.

(Development Unit)

Figure 2:
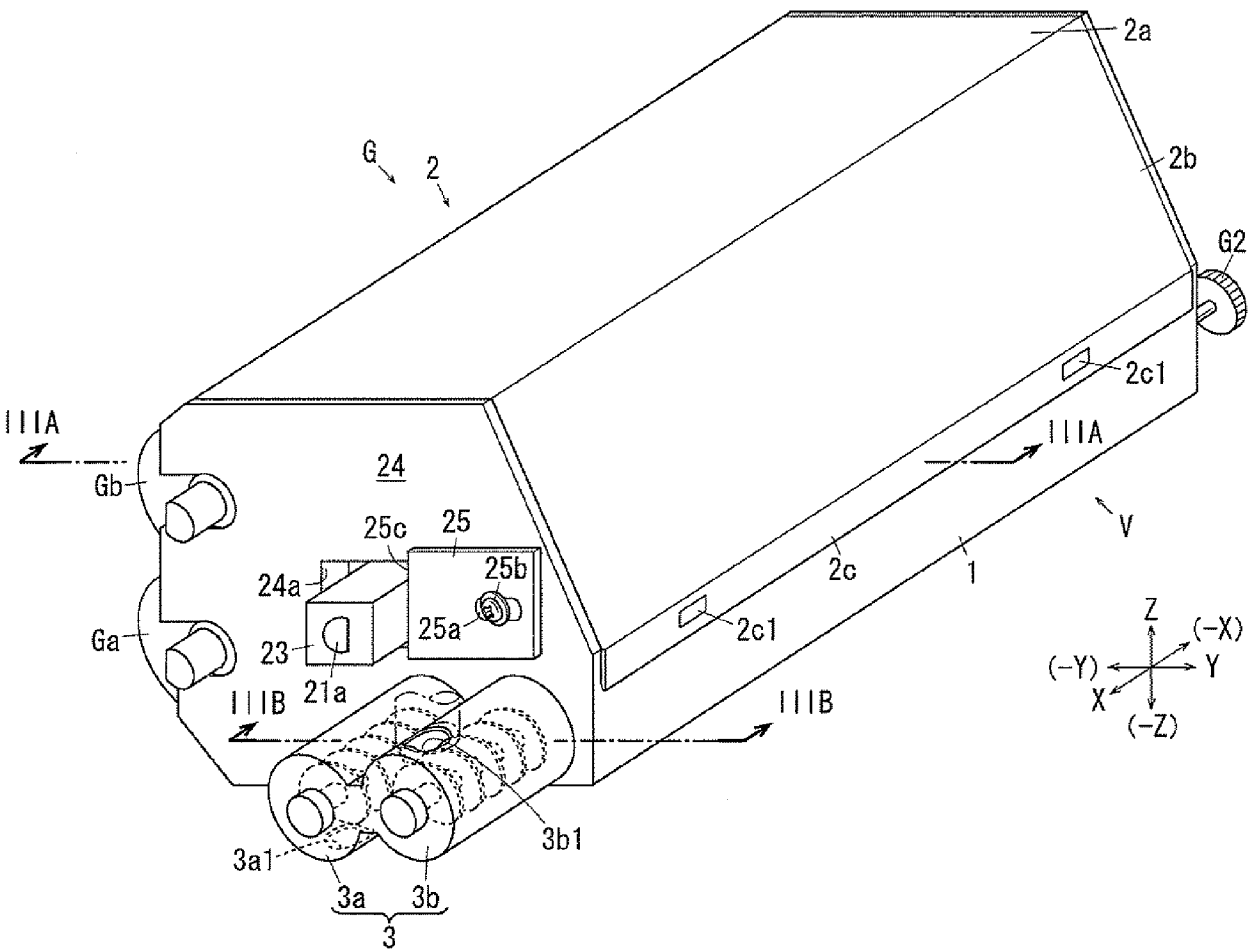
FIG. 2 is a perspective view of a development unit body according to Example 1.

FIG. 2 is a perspective view of a development unit body according to Example 1.

Figure 3A:
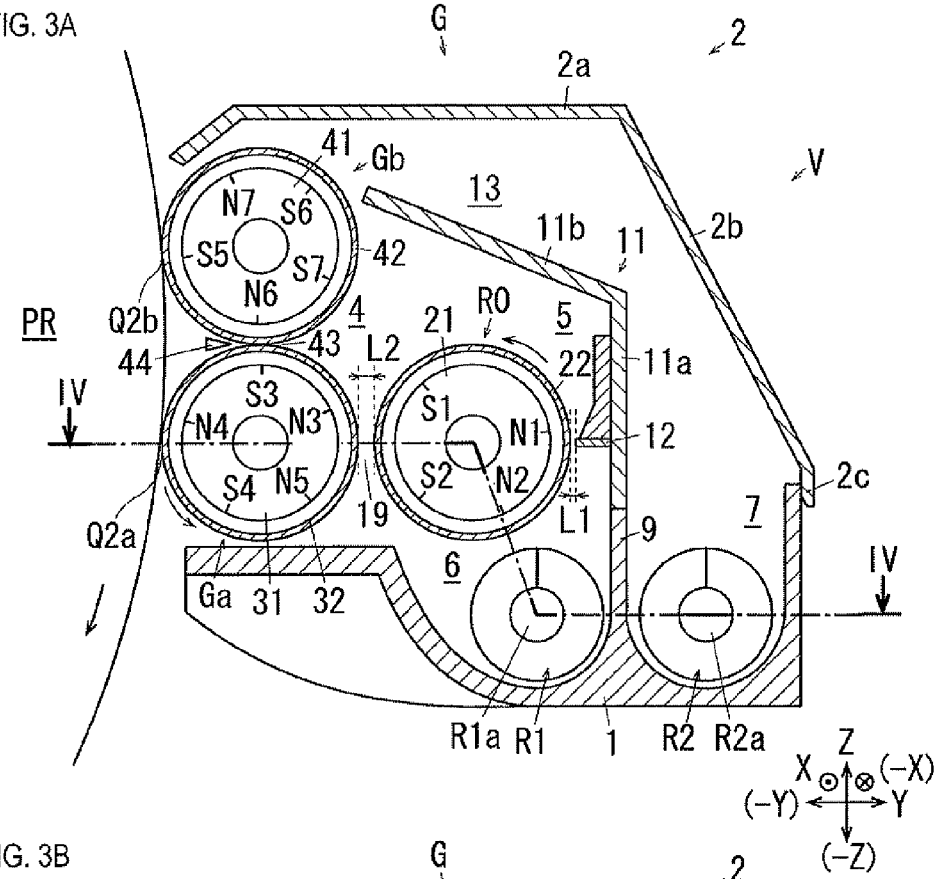
FIGS. 3A and 3B are views for explaining a development unit according to Example 1, FIG. 3A being a sectional view taken on line IIIA-IIIA in FIG. 2, FIG. 3B being a sectional view taken on line IIIB-IIIB in FIG. 2.
Figure 3B:
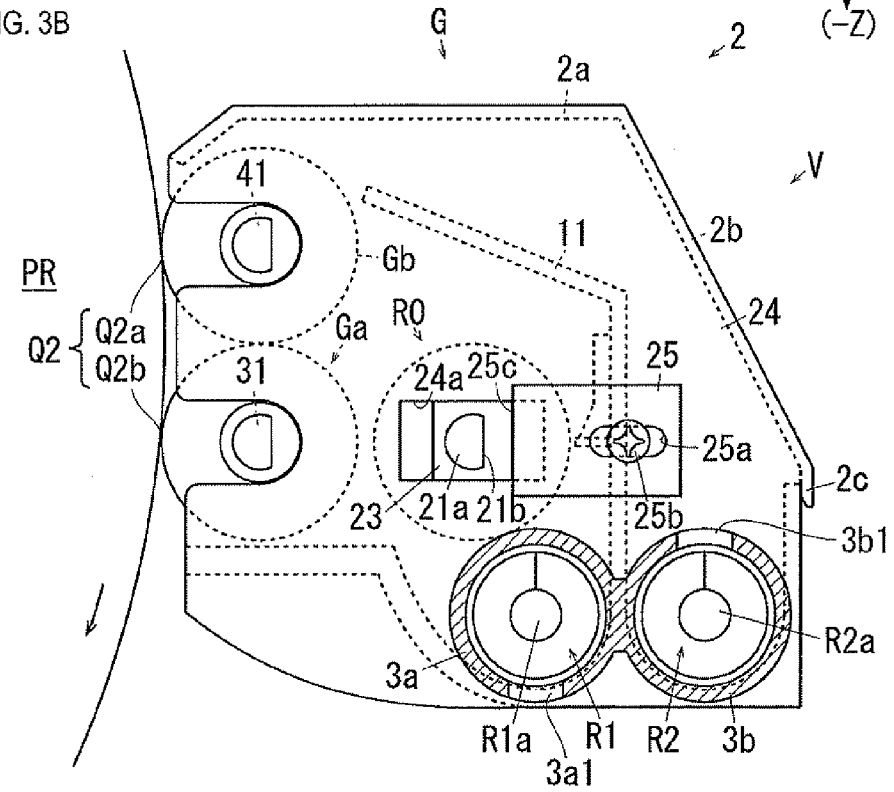

FIGS. 3A and 3B are views for explaining the development unit according to Example 1. FIG. 3A is a sectional view taken on line IIIA-IIIA in FIG. 2, and FIG. 3B is a sectional view taken on line IIIB-IIIB in FIG. 2.

Figure 4:
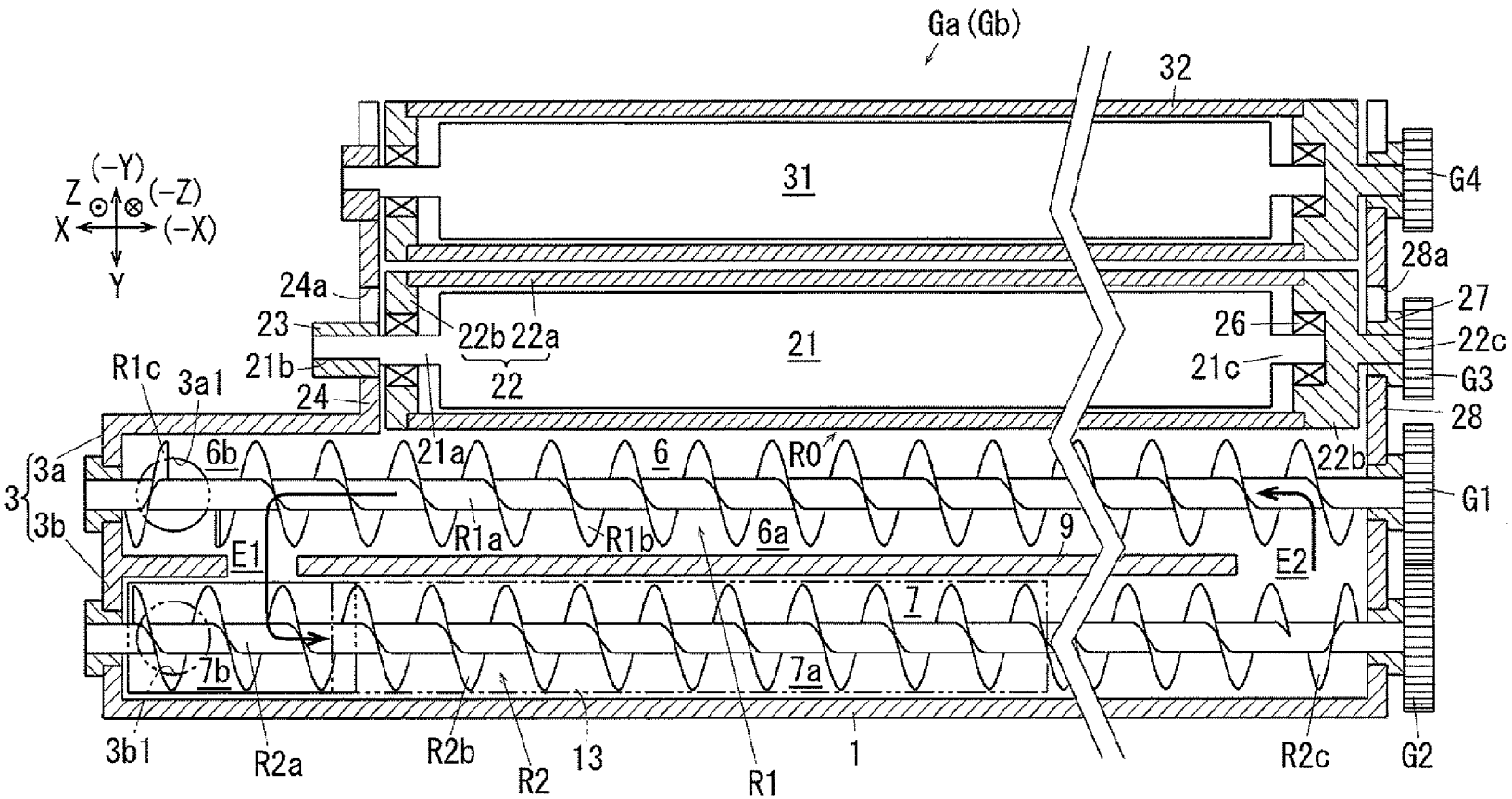
FIG. 4 is a sectional view taken on line IV-IV in FIG. 3A.

FIG. 4 is a sectional view taken on line IV-IV in FIG. 3A.

In FIGS. 2, 3A-38 and 4, the development unit G disposed to be opposed to the photoconductor PR in the developing area Q2 has a developing vessel V for receiving a developing agent. The developing vessel V has a vessel body 1, a vessel cover 2 as an example of a cover member for covering a top end of the vessel body 1, and a front connection member 3 coupled with a front end of the vessel body 1.

(Explanation of Developing Vessel)

In FIGS. 3A and 3B, a developing roll chamber 4 as an example of a holder receiving chamber for receiving developing rolls Ga and Gb is formed inside the vessel body 1. The developing rolls Ga and Gb are provided as examples of developing agent holders and as examples of developing members. A supply roll chamber 5 as an example of a feeder receiving chamber for receiving a supply roll R0 is disposed on the right side of the developing roll chamber 4 and adjacently thereto. The supply roll R0 is provided as an example of a feed member. A first stirring chamber 6 is disposed obliquely under the supply roll chamber 5 and adjacently thereto, and a second stirring chamber 7 is disposed on the right side of the first stirring chamber 6 and adjacently thereto.

The vessel cover 2 has a plate-like top wall 2*a*, an inclined wall 2*b*, and a contact wall 2*c*. The top wall 2*a* extends horizontally in the top end portion of the vessel cover 2. The inclined wall 2*b* extends obliquely right downward from a right end of the top wall 2*a*. The contact wall 2*c* extends downward from a right lower end of the inclined wall 2*b* so as to come into contact with a side wall of the developing vessel body 1. In FIG. 2, when the vessel cover 2 is attached to the vessel body 1, a claw as an example of an attaching portion formed in an outside surface of the vessel body 1 is fitted to a hanging hole 21*c* as an example of an attached portion formed in the contact wall 2*c*. Thus, the vessel cover 2 is fixed to the vessel body 1.

In FIGS. 3A-3B and 4, the first stirring chamber 6 has a first main stirring chamber 6*a* formed inside the vessel body 1 and a discharge chamber 6*b* formed in a left portion 3*a* of the front connection member 3. On the other hand, the second stirring chamber 7 has a second main stirring chamber 7*a* formed inside the vessel body 1 and a supply chamber 7*b* formed in a right portion 3*b* of the front connection member 3.

Between the first stirring chamber 6 and the second stirring chamber 7 inside the vessel body 1, a partition wall 9 as an example of a partition portion is formed in a portion excluding front and rear opposite end portions of the first and second main stirring chambers 6*a* and 7*a*. Thus, the first main stirring chamber 6*a* and the second main stirring chamber 7*a* are partitioned by the partition wall 9. The first main stirring chamber 6*a* and the second main stirring chamber 7*a* are configured so that a developing agent can flow in the first and second main stirring chambers 6*a* and 7*a* through a front inflow portion E1 and a rear inflow portion E2 of the front and rear opposite end portions.

A circulating chamber 6+7 is constituted by the first stirring chamber 6 and the second stirring chamber 7.

In FIGS. 2, 3B and 4, a discharge port 3*a*1 as an example of a developing agent discharge portion for discharging a deteriorated developing agent bit by bit is provided in a lower portion of the left portion 3*a* of the front connection member 3. In an upper portion of the right portion 3*b* of the front connection member 3, a supply port 3*b*1 is provided as an example of a supply portion for supplying a new developing agent from a not-shown developing agent cartridge as an example of a developing agent storage vessel.

In the development unit G according to Example 1, the supply port 3*b*1 is provided on the downstream side of the discharge port 3*a*1 in a developing agent conveyance direction so as to reduce the ratio with which a new developing agent supplied from the support port 3*b*1 will be discharged immediately after the developing agent is supplied.

In an upper end of the partition wall 9, an internal partition member 11 extending in the front-rear direction is supported as an example of a partition portion. The internal partition member 11 has a vertical wall 11*a* as an example of a regulation member support portion, and an internal inclined wall 11*b*. The vertical wall 11*a* extends upward from the upper end of the partition wall 9. The internal inclined wall 11*b* extends obliquely left upward from an upper end of the vertical wall 11*a*. Inside the supply roll chamber 5 on the left surface side of the vertical wall 11*a*, a plate-like trimmer 12 extending in the front-rear direction to limit the thickness of a developing agent adhering to the surface of the supply roll R0 is supported as an example of a layer thickness limiting member and as an example of a developing agent limiting member.

An inflow path 13 which allows a developing agent to flow into the second stirring chamber 7 is formed between the internal partition member 11 and the top wall 2*a* and the inclined wall 2*b* of the vessel cover 2.

(Explanation of Stirring Members)

Figure 5A:
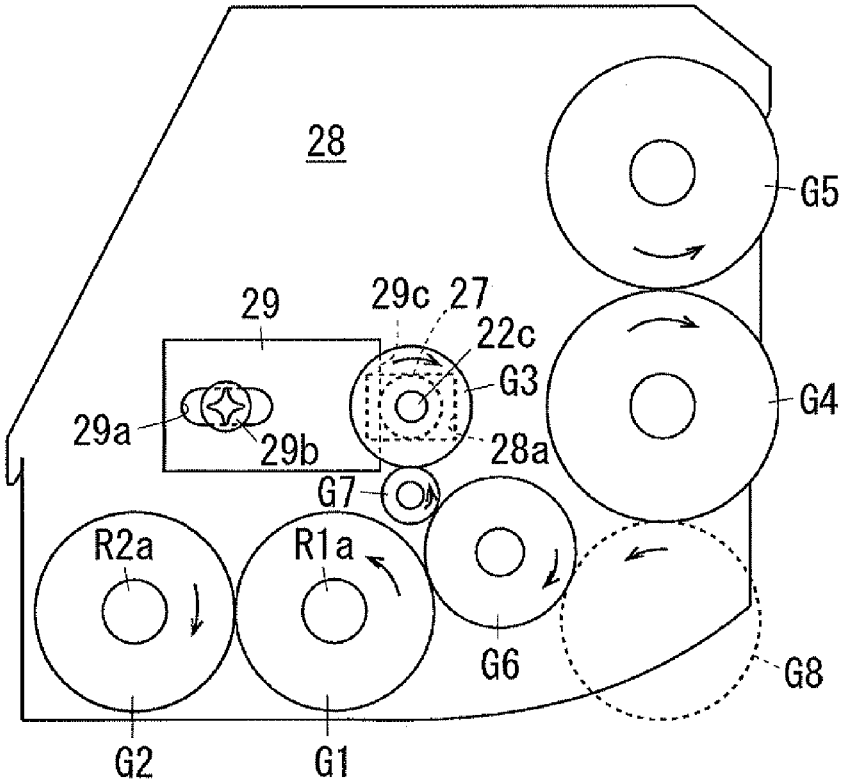
FIGS. 5A and 5B are views for explaining states where the development unit according to Example 1 is viewed from behind, FIG. 5A being an overall view of a developing vessel, FIG. 5B being a main portion enlarged view of a portion of gears for a supply roll in FIG. 5A.
Figure 5B:
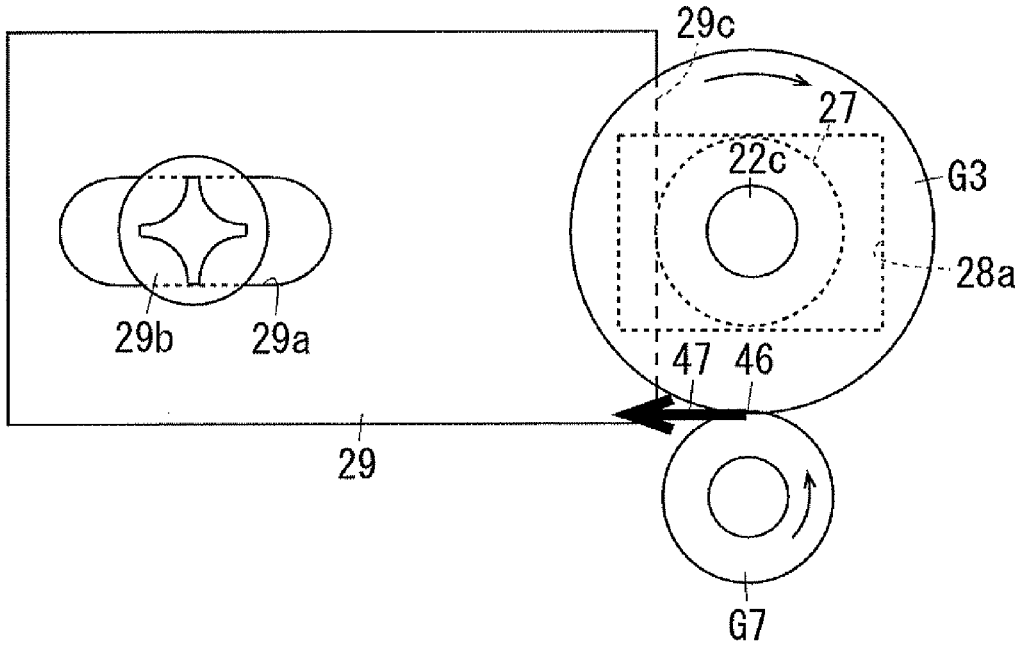

FIGS. 5A and 5B are views for explaining states where the development unit according to Example 1 is viewed from behind. FIG. 5A is an overall view of the development vessel, and FIG. 5B is a main portion enlarged view of a portion of gears for the supply roll in FIG. 5A.

In FIGS. 3A-3B and 4, a supply auger R1 as an example of a first stirring member and an admixing auger R2 as an example of a second stirring member are disposed in the first stirring chamber 6 and the second stirring chamber 7 respectively to convey a developing agent while stirring the developing agent. In FIG. 4, the supply auger R1 has a first rotation shaft R1*a* extending in the axial direction of the supply roll R0, a first main conveyance blade R1*b* and a first reverse conveyance blade R1*c* which are supported on the outer circumference of the first rotation shaft R1*a*.

The first main conveyance blade R1*b* is provided between the rear inflow portion E2 and the front inflow portion E1 so as to convey a developing agent from the rear side to the front side.

The first reverse conveyance blade R1*c* is provided near the discharge port 3*a*1 so as to set the developing agent to be conveyed in a reverse direction to the conveyance direction of the first main conveyance blade R1*b* to thereby allow the developing agent to flow from the first stirring chamber 6 into the second stirring chamber 7 through the front inflow portion E1.

In FIGS. 4 and 5A-5B, the first rotation shaft R1*a* is rotatably supported by a front surface wall of the left portion 3*a* of the front connection member 3 and a rear surface wall of the developing vessel body 1, and a gear G1 as an example of a gear is supported on a rear end of the first rotation shaft R1*a*.

In the same manner as the supply auger R1, the admixing auger R2 has a second rotation shaft R2*a*, a second main conveyance blade R2*b* and a second reverse conveyance blade R2*c*. The second main conveyance blade R2*b* is provided between the supply port 3*b*1 and the rear inflow portion E2 so as to convey a developing agent from the front side to the rear side. The reverse conveyance blade R2*c* is provided behind the rear inflow portion E2 so as to set the developing agent to be conveyed in a reverse direction to the conveyance direction of the second main conveyance blade R2*b* to thereby allow the developing agent to flow from the second stirring chamber 7 into the first stirring chamber 6 through the rear inflow portion E2. The second rotation shaft R2*a* is rotatably supported by a front surface wall of the right portion 3*b* of the front connection member 3 and the rear surface wall of the developing vessel body 1, and a gear G2 as an example of a gear for engaging with the gear G1 is supported on a rear end of the second rotation shaft R2*a*.

(Explanation of Supply Roll)

In FIGS. 3A-3B and 4, the supply roll. R0 in the supply roll chamber 5 has a supply magnet roll 21 as an example of a magnet member and a supply sleeve 22 as an example of a supply rotating body. The supply magnet roll 21 cannot rotate. The supply sleeve 22 is rotatably supported on the outer circumference of the supply magnet roll 21.

In FIG. 3A, the supply sleeve 22 in Example 1 is disposed at a trimmer gap L1 an example of a gap from the trimmer 12. In Example 1, the trimmer gap L1 is set at 0.80 [mm] by way of example.

In FIG. 3A, the supply magnet roll 21 has a pickup magnetic pole N1 as an example of an adsorption pole for adsorbing the developing agent in the first main stirring chamber 6*a* onto the surface of the supply sleeve 22. The pickup magnetic pole N1 in Example 1 is disposed to face the trimmer 12 so as to be also used as a trimming magnetic pole as an example of a regulation pole.

A supplying magnetic pole Si whose polarity is reverse to that of the pickup magnetic pole N1 is disposed on the downstream side of the pickup magnetic pole N1, and a returned magnetic pole S2 whose polarity is the same as that of the supplying magnetic pole S1 is disposed on the downstream side of the supplying magnetic pole S1. Thus, the magnetic force for adsorbing a developing agent on the supply sleeve 22 is weakened in an area between the supplying magnetic pole S1 and the returned magnetic pole S2 which have the same polarity, so that the developing agent on the surface of the supply sleeve 22 is apt to leave the supply sleeve 22. The magnetic force for adsorbing a developing agent on the supply sleeve 22 acts again in the vicinity of each magnetic pole S1, S2.

A pickoff magnetic pole N2 as an example of a release pole for releasing the developing agent from the surface of the supply sleeve 22 is disposed on the downstream side of the returned magnetic pole S2 and on the upstream side of the pickup magnetic pole N1. Thus, in Example 1, the magnetic force for adsorbing a developing agent on the supply sleeve 22 is weakened in an area between the pickup magnetic pole N1 and the pickoff magnetic pole N2 which have the same polarity, so that the developing agent on the surface of the supply sleeve 22 is dropped down from the supply sleeve 22 and returned to the first stirring chamber 6. The returned developing agent is conveyed while being stirred again in the circulating chamber 6+7, and supplied to the supply sleeve 22 by the pickup magnetic pole N1.

(Explanation of Mechanism for Adjusting Trimmer Gap)

The supply sleeve 22 has a cylindrical supply sleeve body 22*a* as an example of a main body of the rotating body, and supply hubs 22*b* as examples of shaft-end support portions supported at the front and rear opposite ends of the supply sleeve body 22*a*.

In FIG. 4, a front end 21*a* of the supply magnet roll 21 is rotatably supported on the front supply hub 22*b* so as to penetrate the front supply hub 22*b* forward. Thus, a D-cut portion 21*b* as an example of a rotation stopper portion is formed in the front end portion of the supply magnet roll 21. The D-cut portion 21*b* is supported on a rotation stopper bearing 23 as an example of a positioned portion. The rotation stopper bearing 23 is supported movably in an opening 24*a* formed as an example of an adjustment support portion in a front end wall 24 of the developing vessel V. The opening 24*a* in Example 1 is formed into a rectangular shape extending in the left-right direction to bring the supply roll R0 close to/separate from the trimmer 12, that is, to reduce/increase the gap between the trimmer 12 and the supply roll R0. Thus, the supply roll R0 is supported movably in the left-right direction.

In FIGS. 2 and 3B, a positioning plate 25 as an example of a positioning member is supported on the front surface of the front end wall 24 of the developing vessel V and on the right side of the opening 24*a*. In the positioning plate 25, a long hole 25*a* extending in the left-right direction is formed as an example of a fixed portion in the right portion. The positioning plate 25 is fixed to the front end wall 24 by a screw 25*b* which penetrates the long hole 25*a*. In the left end of the positioning plate 25, a positioning face 25*c* as an example of a positioning portion is formed to come in contact with the rotation stopper bearing 23 to thereby set the left-right position thereof.

As a result, when the screw 25*b* is loosened, the positioning plate 25 can move in the left-right direction to adjust the left-right position of the positioning face 25*c*. When the screw 25*b* is fastened, the position of the positioning plate 25 is fixed. Thus, when the position of the positioning plate 25 is adjusted, the left-right position of the bearing 23 in contact with the positioning face 25*c*, that is, the left-right position of the supply roll R0 can be adjusted.

In addition, a rear end 21*c* of the supply magnet roll 21 is supported on the rear supply hub 22*b* through a bearing 26.

A rear end portion 22*c* of the rear supply hub 22*b* is rotatably supported on a bearing 27. The bearing 27 is supported movably in an opening 28*a* formed as an example of an adjustment guide portion in a rear end wall 28 of the developing vessel V. The opening 28*a* in Example 1 is configured in the same manner as the opening 24*a* formed in the front end wall 24. In addition, a positioning plate 29 configured in the same manner as the positioning plate 25 supported on the front end wall 24 is supported on the rear end wall 28 so as to come in contact with the bearing 27 to thereby set the left-right position of the supply roll R0. In FIGS. 4 and 5A-5B, a gear G3 as an example of a transmitted member and as an example of a gear is supported at the rear of the bearing 27 in the rear end portion 22*c* of the supply hub 22*b*.

Thus, the supply magnet roll 21 is unrotatably supported on the rotation stopper bearing 23, while the supply sleeve 22 is supported rotatably on the outer circumference of the supply magnet roll 21. Due to the openings 24*a* and 28*a*, the supply roll R0 as a whole is supported movably in the left-right direction to be brought close to/separate from the trimmer 12, while the supply roll R0 is positioned relatively to the trimmer 12 by the pair of front and rear positioning plates 25 and 29.

Figure 6C:
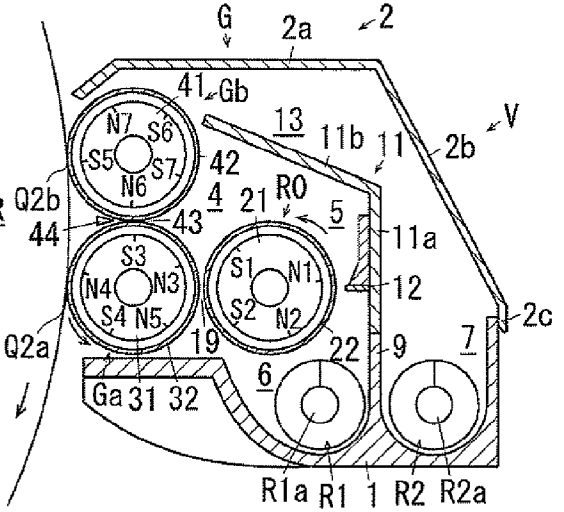
FIGS. 6A, 6B, 6C and 6D are views for explaining adjustment of a trimmer gap according to Example 1, FIG. 6A being a view for explaining the state shown in FIG. 3A, FIG. 6B being a view for explaining the state shown in FIG. 3B, FIG. 6C being a view for explaining a state where the supply roll has been separated from a trimmer at the state shown in FIG. 6A, FIG. 6D being a view for explaining a state where the supply roll has been separated from the trimmer at the state shown in FIG. 6B to reach the position shown in FIG. 6C.
Figure 6D:
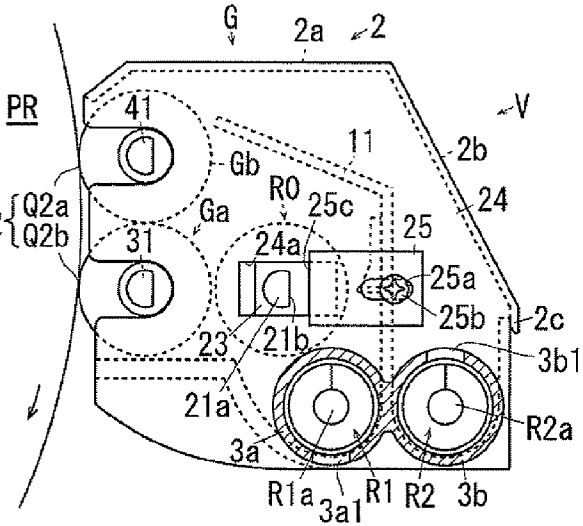
Figure 6A:
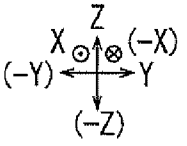
Figure 6A:
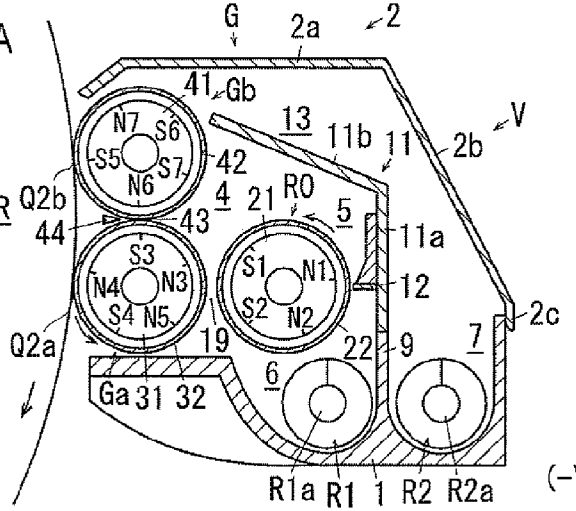
Figure 6B:
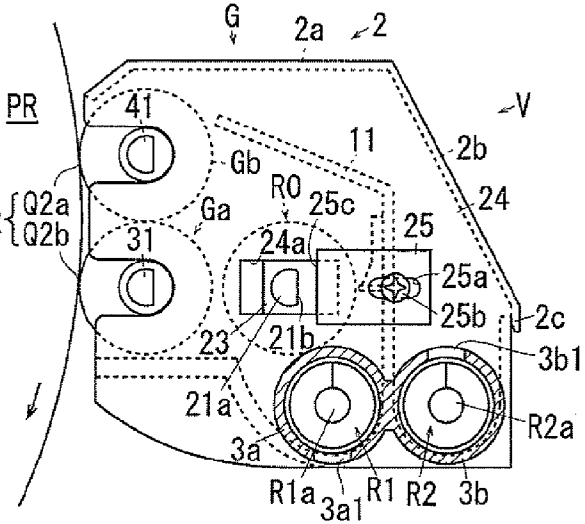

FIGS. 6A-6D are views for explaining adjustment of a trimmer gap according to Example 1. FIG. 6A is a view for explaining the state shown in FIG. 3A. FIG. 6B is a view for explaining the state shown in FIG. 3B. FIG. 6C is a view for explaining the state where the supply roll has been separated from the trimmer at the state shown in FIG. 6A. FIG. 6D is a view for explaining the state where the supply roll has been separated from the trimmer at the state shown in FIG. 6B to reach the position shown in FIG. 6C.

Assume that a trimmer gap L1 which is a distance between the trimmer 12 and the supply roll R0 is adjusted in FIGS. 6A-6D. In this case, screws 25*b* and 29*b* are loosened at the states shown in FIGS. 6A and 6B. When the screws 25*b* and 29*b* are fastened in the state that the positions of the positioning plates 25 and 29 have been shifted and adjusted in the left-right directions, the position of the supply roll R0 in contact with the positioning plates 25 and 29 is adjusted as shown in FIGS. 6C and 6D. Accordingly, the trimmer gap L1 between the supply roll R0 and the trimmer 12 is adjusted by the adjustment of the positioning plates 25 and 29.

In Example 1, the movable range of the supply roll R0 is set so that the range in which the trimmer gap L1 can be adjusted is set at ±50 [μm]=±0.05 [mm] by way of example.

(Explanation of First Developing Roll)

In FIGS. 2 and 3A-3B, a first developing roll Ca disposed between the supply roll R0 and the photoconductor PR and a second developing roll Gb disposed above the first developing roll Ga and in opposition to the photoconductor PR are received in the developing roll chamber 4.

In the same manner as the supply roll R0, the first developing roll Ga has a first magnet roll 31 as an example of a magnet member and a first developing sleeve 32 as an example of a rotating body. The first magnet roll 31 cannot rotate. The first developing magnet roll 32 is supported rotatably on the outer circumference of the first magnet roll 31. In Example 1, the first developing sleeve 32 is disposed with a delivery gap L2 as an example of a gap from the supply sleeve 22. In Example 1, the delivery gap L2 is set at 3 [mm] by way of example.

In FIG. 3A, the first magnet roll 31 has a supplied magnetic pole N3 which is disposed on the downstream side of a supply area 19 opposed to the supply sleeve 22 in the rotation direction of the first developing sleeve 32. The supplied magnetic pole N3 generates a magnetic force by which a developing agent from the supply sleeve 22 can be moved to the surface of the first developing sleeve 32 so as to adhere thereto. In Example 1, the polarity of the supplied magnetic pole N3 is set to be reverse to that of the supplying magnetic pole S1, and disposed corresponding to the position where the magnetic force to make the developing agent adhere to the supply sleeve 22 is weak between the supplying magnetic pole S1 and the returned magnetic pole S2 and the distance between the supply sleeve 22 and the first developing sleeve 32 is narrower than that in the position of the supplying magnetic pole S1. Thus, almost all the developing agent whose amount is limited by the trimmer 12 and then adheres to the surface of the supply sleeve 22 is moved to the surface of the first developing sleeve 32, and adsorbed and held on the surface of the first developing sleeve 32.

On the downstream side of the supplied magnetic pole N3 in the rotational direction of the first developing sleeve 32, a delivering magnetic pole S3 whose polarity is reverse to that of the supplied magnetic pole N3 is disposed to be opposed to the second developing roll Gb. On the downstream side of the delivering magnetic pole S3, a first developing magnetic pole N4 whose polarity is reverse to that of the delivering magnetic pole S3 is disposed to be opposed to the photoconductor PR. The first developing magnetic pole N4 radially forms so-called chains of the developing agent on the surface of the first developing sleeve 32. On the downstream side of the first developing magnetic pole N4, a first conveying magnetic pole S4 whose polarity is reverse to that of the first developing magnetic pole N4 is disposed so as to generate a magnetic force with which the developing agent which has not been used in a first developing area Q2*a* can be made to adhere to the surface of the first developing sleeve 32 and be conveyed to the downstream side.

On the downstream side of the first conveying magnetic pole S4 and on the upstream side of the supplied magnetic pole N3, a returning magnetic pole N5 whose polarity is the same as that of the supplied magnetic pole N3 is disposed as a separation pole. Thus, the magnetic force to adsorb a developing agent onto the first developing sleeve 32 is weakened between the supplied magnetic pole N3 and the returning magnetic pole N5 so that the developing agent is apt to leave the first developing sleeve 32. In Example 1, due to the returned magnetic pole S2 disposed correspondingly to the area between the supplied magnetic pole N3 and the returning magnetic pole N5, the developing agent on the surface of the first developing sleeve 32 where the magnetic force adsorbing the developing agent is weakened is adsorbed onto the returned magnetic pole S2. Thus, the residual developing agent which has not been used in the first developing area Q2*a* is returned from the first developing sleeve 32 to the surface of the supply sleeve 22, and returned to the first stirring chamber 6 by the pickoff magnetic pole N2.

In FIG. 4, the first developing sleeve 32 is configured in the same manner as the supply sleeve 22. A gear G4 as an example of a gear is supported on a rear end of the first developing sleeve 32. In FIGS. 2, 3A-3B and 4, unlike the supply roll R0, the first developing roll Ga in Example 1 is supported in the developing vessel V so that the first developing roll Ga cannot move in the left-right direction but the first developing sleeve 32 can rotate.

(Explanation of Second Developing Roll)

In the same manner as the supply roll R0 or the first developing roll Ga, the second developing roll Gb has a second magnet roll 41 as an example of a magnet member and a second developing sleeve 42 as an example of a rotating body. The second magnet roll 41 cannot rotate. The second developing sleeve 42 is supported rotatably on the outer circumference of the second magnet roll 41. The second developing roll Gb in Example 1 is disposed above the first developing roll Ga and closely thereto.

The second magnet roll 41 has a receiving magnetic pole N6 which is disposed to be opposed to the delivering magnetic pole S3 and whose polarity is reverse to that of the delivering magnetic pole S3.

On the downstream side of the receiving magnetic pole N6 in the rotation direction of the second developing sleeve 42, a second developing magnetic pole S5 whose polarity is reverse to that of the receiving pole N6 is disposed correspondingly to the second developing area Q2*b* opposed to the photoconductor PR. The second developing magnetic pole S5 forms chains of the developing agent in the second developing area Q2*b* in the same manner as the first developing magnetic pole N4.

On the downstream side of the second developing magnetic pole S5, a second conveying magnetic pole N7 whose polarity is reverse to the second developing magnetic pole S5 is disposed to adsorb the developing agent onto the surface of the second developing sleeve 42 to thereby convey the developing agent to the downstream side in the same manner as the first conveying magnetic pole S4.

On the downstream side of the second conveying magnetic pole N7, two pickoff magnetic poles S6 and S7 as examples of separating magnetic poles are disposed at a distance from each other along the rotation direction. The two pickoff magnetic poles S6 and S7 are set to have the same polarity, that is, reverse to the polarity of the second conveying magnetic pole N7. Thus, the developing agent is apt to leave the second developing sleeve 42 in an area between the pickoff magnetic poles S6 and S7. In Example 1, an upper end of the internal inclined wall 11*b* is disposed correspondingly to a position between the pickoff magnetic poles S6 and S7. Thus, the developing agent leaving the second developing sleeve 42 due to the effect of gravitation or the like is returned to the second stirring chamber 7 through the inflow path 13 and conveyed again while being stirred.

In FIG. 4, the second developing sleeve 42 is configured in the same manner as the first developing sleeve 32. A gear G5 engaging with the gear G4 of the first developing sleeve 32 is supported as an example of a gear on the rear end of the second developing sleeve 42. In addition, the second developing roll Gb in Example 1 is supported in the developing vessel V unrotatably in the left-right direction in the same manner as the first developing roll Ga, while the second developing sleeve 42 is supported rotatably.

(Explanation of Distribution Member)

In FIG. 3A, a wedge-like distribution member 44 is disposed on the left side of a delivery area 43 in which the first developing roll Ga and the second developing roll Gb are opposed to each other to deliver the developing agent from the first developing roll Ga to the second developing roll Gb. A front end of the distribution member 44 is disposed closely to the delivery area 43 so that the developing agent of the delivery area 43 can be distributed to the first developing roll Ga side and the second developing roll Gb side by the distribution member 44.

In Example 1, the position of the distribution member 44 is set to make the amount of a developing agent adsorbed onto the surface of the first developing roll Ga equal to the amount of a developing agent adsorbed onto the surface of the second developing roll Gb. That is, the developing agent is distributed so that the amount of a developing agent supplied to the developing area Q2*a* can be equalized to the amount of a developing agent supplied to the developing area Q2*b*.

(Explanation of Drive System of Development Unit)

In FIGS. 5A and 5B, in the developing vessel V in Example 1, an input gear G6 engaging with the gear G1 of the supply auger R1 is rotatably supported as an example of a gear on the rear end wall 28. Obliquely above the input gear G6, an intermediate gear G7 engaging with the input gear G6 and engaging with the gear G3 of the supply roll R0 is rotatably supported as an example of a transmission member and an example of a gear.

The input gear G6 is provided in the copying machine body U1 and engages with an output gear G8. The output gear G8 is provided as an example of a gear to which rotations are transmitted from a not-shown motor as an example of a drive source. In addition, the output gear G8 also engages with the gear G4 of the first developing roll Ga. Thus, when the not-shown motor drives and rotates the output gear G8 in the development unit G in Example 1, the developing rolls Ga and Gb rotate due to the gears G4 and G5 while the augers R1 and R2 rotate due to the input gear G6 and the gears G1 and G2, and the supply roll R0 also rotates due to the input gear G6, the intermediate gear G7 and the gear G3.

(Explanation of Force Acting on Supply Roll During Rotation of Drive System)

In FIG. 55, the intermediate gear G7 in Example 1 is disposed gravitationally under the gear G3 of the supply roll R0 which can move in the left-right direction. That is, the direction connecting the rotation center of the intermediate gear G7 with the rotation center of the gear G3 is set to intersect the left-right direction in which the supply roll R0 moves with respect to the trimmer 12. Thus, during the rotation of the intermediate gear G7, the direction of a force 47 with which the teeth of the intermediate gear G7 push the teeth of the gear G3 of the supply roll R0 has a right-direction component in an engagement position 46 in which the intermediate gear G7 and the gear G3 engages with each other, as shown in FIG. 5B. That is, with the rotation of the intermediate gear G7, the supply roll R0 receives a force toward the right and a force to press the supply roll R0 onto the positioning plates 25 and 29 acts thereon.

(Effect of Example 1)

When an image forming operation is executed in the copying machine U in Example 1 configured thus, the augers R1 and R2 convey a developing agent in the developing vessel V while stirring the developing agent, and the developing agent is adsorbed onto the supply sleeve 22 due to the magnetic force of the supply magnet roll 21. The developing agent on the surface of the supply sleeve 22 is conveyed to the supply area 19 while the amount of the developing agent is limited by the trimmer 12.

In the supply area 19, the developing agent on the surface of the supply sleeve 22 whose amount has been limited by the trimmer 12 moves to the first developing sleeve 32 due to the effect of the magnetic force of the magnetic field between the supply magnet roll 21 and the first magnet roll 31. Then, the developing agent on the surface of the first developing sleeve 32 is conveyed to the delivery area 43 with the rotation of the first developing sleeve 32.

In the delivery area 43, the developing agent on the first developing roll Ga is distributed to the first developing roll Ga and the second developing roll Gb by the distribution member 44 due to the magnetic force between the first magnet roll 31 and the second magnet roll 41.

The developing agent distributed to each developing roll Ga, Gb is conveyed to each developing area Q2*a*, Q2*b*, where an electrostatic latent image on the surface of the photoconductor PR is developed into a visible image. Particularly in the development unit G in Example 1, two developing rolls Ga and Gb are provided for one photoconductor PR.

In any development unit in the background art, a development test is performed on each of assembled development units after the development units are assembled. When the amount of a developing agent held on the surface of a developing roll is excessive, the position of a trimmer is adjusted to adjust the distance of a trimmer gap between the developing roll and the trimmer.

In the configuration in which the trimmer is exposed to the outside surface of a developing vessel, the position of the trimmer after the development unit is assembled can be adjusted comparatively easily. However, when the trimmer 12 is supported inside the developing vessel V as in Example 1, an operation to adjust the position of the trimmer 12 in the developing unit G which has been assembled becomes difficult.

On the other hand, in the developing unit G in Example 1, the supply roll R0 whose front and rear opposite ends extend to the outside of the developing vessel V is supported movably in the left-right direction in which the trimmer gap L1 can be expanded/reduced. The supply roll R0 is positioned by the positioning plates 25 and 29. Accordingly, the positioning plates 25 and 29 outside the developing vessel V can be adjusted to adjust the trimmer gap L1 without adjusting the trimmer 12 disposed inside the developing vessel V. That is, even after the developing unit G is assembled, the trimmer gap L1 can be adjusted without disassembling the developing unit G to adjust the trimmer 12 inside the developing vessel V.

In Example 1, the trimmer gap L1 is adjusted on the order of about 10 [μm]. The amount of the adjustment is up to ±50 [μm], which is much smaller than 3 [mm] of the delivery gap L2. In addition, the accuracy required for the delivery gap L2 with which all the developing agent can be delivered from the supply roll R0 to the first developing roll Ga is lower than that of the trimmer gap L1 for limiting the amount of the developing agent. Accordingly, in Example 1, the delivery gap L2 is also affected by the adjustment of the trimmer gap L1, but the fluctuation of the delivery gap L2 gives no adverse affection to image formation.

In addition, in the development unit G in Example 1, the left-right direction in which the supply roll R0 can move is set not to be parallel to the direction connecting the center of the gear G3 of the supply roll R0 with the center of the intermediate gear G7 but to cross the direction. Accordingly, the force 47 generated when the intermediate gear G7 rotates in the position 46 where the gear G3 and the intermediate gear G7 engage with each other has a component to push the supply roll R0 toward the right side, that is, toward the positioning plates 25 and 29. Thus, the supply roll R0 can be positioned by use of driving at the time of starting up the development unit G, without providing any member for pushing the supply roll R0 toward the positioning plates 25 and 29, for example, without providing any urging member such as a coil spring. Accordingly, the development unit G in Example 1 can be positioned with the reduced number of parts such as urging members etc.

When the trimmer gap L1 is adjusted, the gear G3 of the supply roll R0 fluctuates with respect to the intermediate gear G7 so as to change the condition of engagement between the gears G3 and G7. However, the amount of adjustment of the trimmer gap L1 is up to ±50 [mm], which has very small influence on the change in the engagement.

EXAMPLE 2

Figure 7:
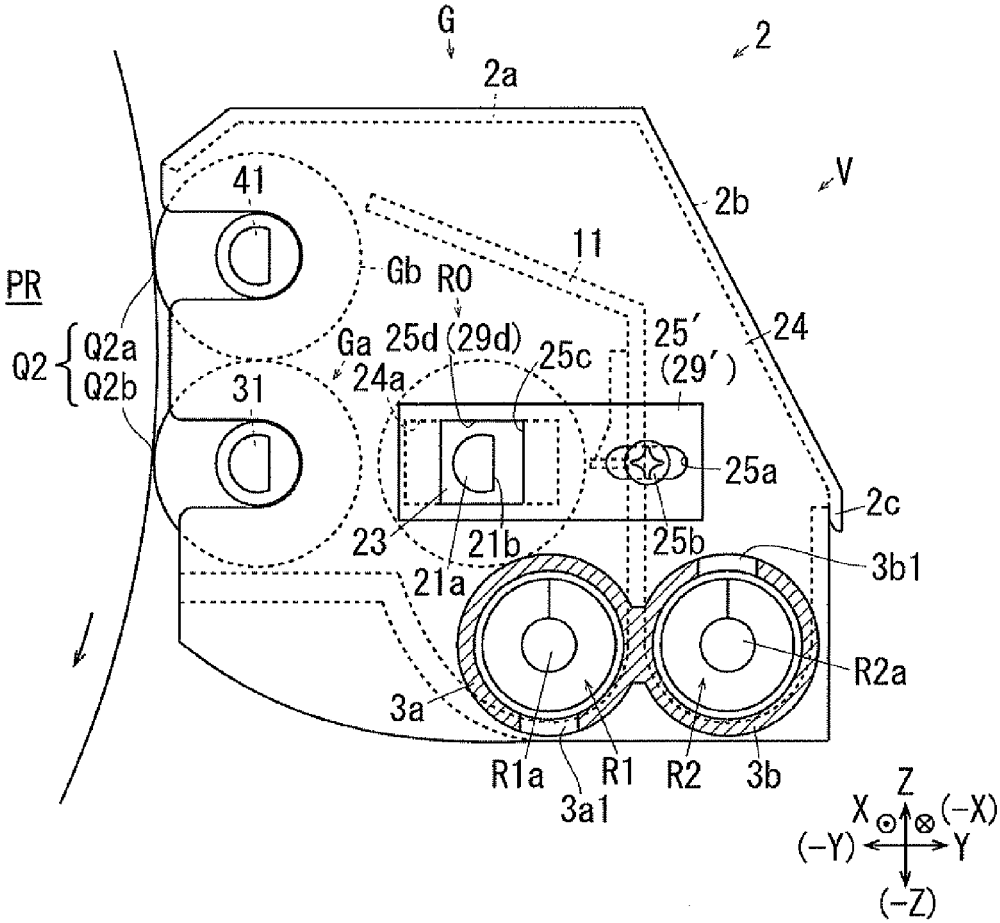
FIG. 7 is a view for explaining a development unit according to Example 2, which view corresponds to FIG. 3B of Example 1.

FIG. 7 is a view for explaining a development unit according to Example 2, which view corresponds to FIG. 3B of Example 1.

Next, Example 2 of the invention will be described. In the description of Example 2, constituent members corresponding to those in Example 1 are referred to by the same numerals and symbols, and detailed description thereof will be omitted.

This Example is configured in the same manner as Example 1, except the following point.

In FIG. 7, in a development unit Gin Example 2, a support hole 25*d*, 29*d* as an example of a positioning support portion is formed in each positioning plate 25', 29'. A bearing 23, 27 is passed through and fitted into the support hole 25*d*, 29*d* and fixedly supported therein. Thus, the support roll R0 is supported movably together with the positioning plates 25' and 29' in Example 2.

(Effect of Example 2)

In the development unit G in Example 2 configured thus, the positions of the positioning plates 25 and 29 are adjusted in the state that screws 25*b* and 29*b* are loosened, so that the support roll R0 moves integrally with the positioning plates 25' and 29' to adjust the trimmer gap L1.

Accordingly, in Example 2, the position of the supply roll R0 is kept in the positioned state regardless of the force with which the intermediate gear 7 pushes the gear G3, in the same manner as in Example 1. Thus, the position of the supply roll. R0 can be set in its intended position surely, as compared with the configuration of Example 1.

EXAMPLE 3

Figure 8:
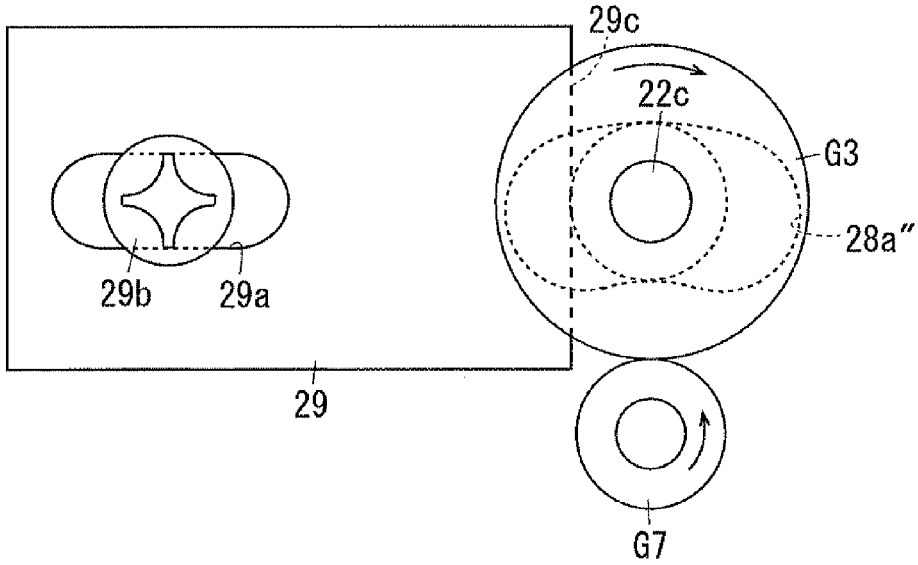
FIG. 8 is a view for explaining a development unit according to Example 3, which view corresponds to FIG. 5B of Example 1.

FIG. 8 is a view for explaining a development unit according to Example 3, which view corresponds to FIG. 5B of Example 1.

Next, Example 3 of the invention will be described. In the description of Example 3, constituent members corresponding to those in Example 1 are referred to by the same numerals and symbols, and detailed description thereof will be omitted.

This Example is configured in the same manner as Example 1, except the following point.

In FIG. 8, in a development unit G in Example 3, openings 24*a*" and 28*a*" are formed in front end rear opposite end walls 24 and 28 by which the supply roll R0 is guided. Each opening 24*a*", 28*a*" is formed into an arc shape around the rotation center of the intermediate gear G7. Thus, when the distance between the supply roll R0 and the trimmer 12 is adjusted, the supply roll R0 moves to approach/leave the trimmer 12 along an arc around the intermediate gear G7.

(Effect of Example 3)

In the development unit G in Example 3 configured thus, when the supply roll R0 is adjusted, the supply roll R0 moves along the arc around the intermediate gear G7 so as to keep the amount of engagement between the gear G3 of the supply roll R0 and the intermediate gear G7. Thus, the engagement is prevented from being deeper or shallower. That is, the amount of movement of the supply roll R0 can be increased, as compared with that in Example 1.

(Modifications)

Examples of the invention have been described above. The invention is not limited to the aforementioned examples, but various modifications may be made on the invention without departing from the gist of the invention stated in the claims thereof. Modifications (H01) to (H08) of the invention will be shown below by way of example.

(H01) In the aforementioned examples, the copying machine U is shown as an image forming apparatus. The invention is not limited thereto but maybe also formed as a printer, a fax machine, a multifunctional machine having a plurality or all of these functions, or the like.

(H02) In the aforementioned examples, the copying machine U is designed to use a monochromatic developing agent. The invention is not limited to such a configuration, but may be also applied to a so-called color image forming apparatus for two or more colors.

(H03) In the aforementioned examples, two developing rolls Ga and Gb are provided for the purpose of increase in speed by way of example. The invention is not limited to such a configuration but may be applied to a configuration with a single developing roll or a configuration with three or more developing rolls. In accordance with the configuration, a desired change may be made. For example, the inflow path 13 may be removed when a single developing roll is provided. When the number of developing rolls is three or more, the number of inflow paths 13 may be increased, or the shapes of the inflow paths 13 may be changed.

(H04) In the aforementioned examples, only the supply roll R0 is made movable. The invention is not limited thereto. Either or both of the developing rolls Ga and Gb may be made movable in sync with or independently of the supply roll R0.

(H05) In the aforementioned examples, the movable direction of the supply roll R0 is set in the left-right direction which is a horizontal direction, and the direction connecting the centers of the gears G3 and G7 is set in the gravitational direction. The invention is not limited thereto. The movable direction of the supply roll R0 or the direction connecting the centers of the gears G3 and G7 may be set in a direction tilted with respect to the horizontal direction or the gravitational direction. In addition, the movable direction of the supply roll R0 does not have to be perpendicular to the direction connecting the centers of the gears G3 and G7, but may be set to cross the direction connecting the centers of the gears G3 and G7 at an angle tilted with respect to the perpendicularity.

(H06) In the aforementioned examples, the position of the trimmer 12 is not limited to the position shown in the examples but may be changed desirably in accordance with design or the like.

(H07) In the aforementioned examples, the illustrated specific numeric values or the layouts etc. of magnetic poles in the magnet rolls 21, 31 and 41 are not limited to those layouts shown in the examples but may be changed desirably in accordance with design or the like.

(H08) In the aforementioned examples, each of the supply roll R0, the developing rolls Ga and Gb, the photoconductor PR, etc. has a roller or drum shape. The invention is not limited thereto. Each of the supply roll R0, the developing rolls Ga and Gb, the photoconductor PR, etc. maybe designed to have a belt-like shape or the like.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A development unit comprising:

a developing vessel in which a developing agent is received;

a developing member which is opposed to an image holder on which a latent image is formed, the developing member rotating while holding the developing agent on a surface thereof, to thereby develop the latent image on the surface of the image holder into a visible image;

a supply member which is supported in the developing vessel and disposed to be opposed to the developing member, the supply member rotating the developing agent in the developing vessel while holding the developing agent on a surface of the supply member to thereby supply the developing agent held on the surface to the developing member, the supply member supplies the developing agent to the developing member under a condition where the supply member is not in contact with the developing member; and a thickness limiting member which is supported in the developing vessel and disposed to be opposed to the supply member on an upstream side of a position where the supply member is opposed to the developing member with respect to a rotational direction of the supply member, the thickness limiting member limiting thickness of the developing agent held on the surface of the supply member; wherein:

the supply member is supported movably in a direction to expand or reduce a gap between the thickness limiting member and the supply member so that the gap between the thickness limiting member and the supply member can be adjusted.

2. The development unit according to claim 1, further comprising:

a transmitted member which is supported on the supply member and to which rotation is transmitted;

a transmitting member which engages with the transmitted member to transmit rotation to the transmitted member, a direction in which the supply member moves with respect to the thickness limiting member being disposed to cross a direction connecting a rotation center of the transmitted member with a rotation center of the transmitting member;

a positioned portion which is provided in the supply member; and a positioning member which abuts against the positioned portion so as to position the supply member with respect to the developing vessel to thereby set the gap between the supply member and the thickness limiting member, the positioning member abutting on a downstream side of the positioned portion with respect to a direction of a force generated when the rotation of the transmitting member is transmitted to the transmitted member in a position where the transmitted member and the transmitting member engage with each other.

3. The development unit according to claim 1, wherein:

the developing member includes a first developing member which is disposed to be opposed to the supply member, and a second developing member which is disposed to be opposed to the first developing member and to be opposed to the image holder and which rotates while holding a part of the developing agent held on a surface of the first developing member on a surface of the second developing member.

4. The development unit according to claim 2, wherein:

the developing member includes a first developing member which is disposed to be opposed to the supply member, and a second developing member which is disposed to be opposed to the first developing member and to be opposed to the image holder and which rotates while holding a part of the developing agent held on a surface of the first developing member on a surface of the second developing member.

5. An image forming apparatus comprising:

an image holder;

a latent image forming unit which forms a latent image on a surface of the image holder;

the development unit according to claim 1, which develops the latent image on the surface of the image holder into a visible image;

a transfer unit which transfers the visible image on the surface of the image holder to a medium; and a fixing unit which fixing the visible image transferred to the medium.

6. An image forming apparatus comprising:

an image holder;

a latent image forming unit which forms a latent image on a surface of the image holder;

the development unit according to claim 2, which develops the latent image on the surface of the image holder into a visible image;

a transfer unit which transfers the visible image on the surface of the image holder to a medium; and a fixing unit which fixing the visible image transferred to the medium.

7. An image forming apparatus comprising:

an image holder;

a latent image forming unit which forms a latent image on a surface of the image holder;

the development unit according to claim 3, which develops the latent image on the surface of the image holder into a visible image;

a transfer unit which transfers the visible image on the surface of the image holder to a medium; and a fixing unit which fixing the visible image transferred to the medium.

8. A gap adjusting method for adjusting a gap between a thickness limiting member and a supply member, the supply member being supported movably in a developing vessel in which a developing agent is received, the supply member being disposed to be opposed to a developing member which develops a latent image on a surface of an image holder, the supply member rotating while holding the developing agent in the developing vessel on a surface of the supply member to thereby supply the developing agent held on the surface of the supply member to the developing member, the supply member supplies the developing agent to the developing member under a condition where the supply member is not in contact with the developing member, the thickness limiting member limiting thickness of the developing agent held on the surface of the supply member, the method comprising:

moving the supply member with respect to the thickness limiting member so as to expand or reduce the gap to thereby adjust the gap.

9. A development unit comprising:

a developing vessel in which a developing agent is received;

a developing member which is opposed to an image holder on which a latent image is formed, the developing member rotating while holding the developing agent on a surface thereof, to thereby develop the latent image on the surface of the image holder into a visible image;

a supply member which is supported in the developing vessel and disposed to be opposed to the developing member, the supply member rotating the developing agent in the developing vessel while holding the developing agent on a surface of the supply member to thereby supply the developing agent held on the surface to the developing member; and a thickness limiting member which is supported in the developing vessel and disposed to be opposed to the supply member on an upstream side of a position where the supply member is opposed to the developing member with respect to a rotational direction of the supply member, the thickness limiting member limiting thickness of the developing agent held on the surface of the supply member; wherein:

the supply member is supported movably in a direction to expand or reduce a gap between the thickness limiting member and the supply member so that the gap between the thickness limiting member and the supply member can be adjusted;

the supply member is movable to a plurality of positions including at least a first position and a second position, the first position and the second position both being positions where the visible image can be formed;

when the supply member is at the second position, the gap between the thickness limiting member and the supply member is wider than that when the supply member is at the first position;

when the supply member is at the second position, a distance between the supply member and the developing member is smaller than that when the supply member is at the first position;

when the supply member is at the first position, the thickness limiting member and the supply member are not in contact with each other; and when the supply member is at the second position, the supply member and the developing member are not in contact with each other.

10. The development unit according to claim 9, further comprising:

a transmitted member which is supported on the supply member and to which rotation is transmitted;

a transmitting member which engages with the transmitted member to transmit rotation to the transmitted member, a direction in which the supply member moves with respect to the thickness limiting member being disposed to cross a direction connecting a rotation center of the transmitted member with a rotation center of the transmitting member;

a positioned portion which is provided in the supply member; and a positioning member which abuts against the positioned portion so as to position the supply member with respect to the developing vessel to thereby set the gap between the supply member and the thickness limiting member, the positioning member abutting on a downstream side of the positioned portion with respect to a direction of a force generated when the rotation of the transmitting member is transmitted to the transmitted member in a position where the transmitted member and the transmitting member engage with each other.

11. The development unit according to claim 9, wherein:

the developing member includes a first developing member which is disposed to be opposed to the supply member, and a second developing member which is disposed to be opposed to the first developing member and to be opposed to the image holder and which rotates while holding a part of the developing agent held on a surface of the first developing member on a surface of the second developing member.

12. The development unit according to claim 10, wherein:

the developing member includes a first developing member which is disposed to be opposed to the supply member, and a second developing member which is disposed to be opposed to the first developing member and to be opposed to the image holder and which rotates while holding a part of the developing agent held on a surface of the first developing member on a surface of the second developing member.

13. An image forming apparatus comprising:

an image holder;

a latent image forming unit which forms a latent image on a surface of the image holder;

the development unit according to claim 9, which develops the latent image on the surface of the image holder into a visible image;

a transfer unit which transfers the visible image on the surface of the image holder to a medium; and a fixing unit which fixing the visible image transferred to the medium.

14. An image forming apparatus comprising:

an image holder;

a latent image forming unit which forms a latent image on a surface of the image holder;

the development unit according to claim 10, which develops the latent image on the surface of the image holder into a visible image;

a transfer unit which transfers the visible image on the surface of the image holder to a medium; and a fixing unit which fixing the visible image transferred to the medium.

15. An image forming apparatus comprising:

an image holder;

a latent image forming unit which forms a latent image on a surface of the image holder;

the development unit according to claim 11, which develops the latent image on the surface of the image holder into a visible image;

a transfer unit which transfers the visible image on the surface of the image holder to a medium; and a fixing unit which fixing the visible image transferred to the medium.

* * * * *